US005767438A

United States Patent [19]

Lang et al.

[11] Patent Number: 5,767,438

[45] Date of Patent: Jun. 16, 1998

[54] FRANGIBLE AMMUNITION

[75] Inventors: David Lang, Taylors Lakes; Phillip John Mibus, Benalla, both of Australia

[73] Assignee: ADI Limited, New South Wales, Australia

[21] Appl. No.: 710,595

[22] Filed: Sep. 20, 1996

[30] Foreign Application Priority Data

Sep. 20, 1995 [AU] Australia ..... PN5542

[51] Int. Cl.[6] ..... F42B 8/14

[52] U.S. Cl. ..... 102/444; 102/439; 102/506; 102/529

[58] Field of Search ..... 102/389, 395, 102/430, 439, 444, 498, 501, 506, 517, 529

[56] References Cited

U.S. PATENT DOCUMENTS

| | | | |
|---|---|---|---|
| 4,165,692 | 8/1979 | Dufort | 102/529 |
| 4,334,478 | 6/1982 | Goes et al. | 102/529 |
| 4,947,755 | 8/1990 | Burczynski | 102/506 |
| 4,958,572 | 9/1990 | Martel | 102/529 |
| 5,078,054 | 1/1992 | Ashok etal. | 102/517 |
| 5,237,930 | 8/1993 | Belanger et al. . | |

FOREIGN PATENT DOCUMENTS

| | | | |
|---|---|---|---|
| 96617 | 12/1983 | European Pat. Off. | 102/529 |
| 407288 | 1/1991 | European Pat. Off. | 102/498 |
| 93/16349 | 8/1993 | WIPO . | |

OTHER PUBLICATIONS

Lyman Reloading Handbook for Rifle, Pistol and Muzzle Loading, 45 Edition, 1970 p. 257.

Elf Atochem, Jan. 9, 1994, pp. 1–4.

Rilsan and the Armaments Industry, No. 867.E/ May 1988, pp. 1–5.

*Primary Examiner*—Harold J. Tudor

*Attorney, Agent, or Firm*—McDermott, Will & Emery

[57] ABSTRACT

A frangible projectile (1) is provided which has a conical nose (5) with an included angle in the range 40–41 degrees. The conical nose (5) has a forward end (9) which is blunt. The projectile is made from a mixture of a metal powder and a thermoplastic resin of nylon 11. The metal is about 80% by weight and the projectile has a specific gravity in the range 2.35 to 5.7.

The projectile exhibits desired ballistic characteristics for distances up to about 150 m and can disintegrate on impact with solid objects. In addition a projectile made according to the preferred embodiment and fitted in a 5.56 mm×45 mm military cartridge case (equivalent to a 0.223 inch Remmington case) charged with a propellant such as type AR2207 (by ADI Ltd.) in the range of 25–26 grains, exhibits particularly suitable characteristics for use in firing ranges.

6 Claims, 2 Drawing Sheets

FRANGIBLE AMMUNITION

FIELD OF THE INVENTION

This invention relates to frangible ammunition and relates particularly but not exclusively to a frangible ammunition projectile for use in weapons such as Steyr, M-16, Minimi F-89, Austeyr F88 and others.

DESCRIPTION OF PRIOR ART

Hitherto, frangible projectiles have been used in many applications. For example, it is known to use frangible projectiles in firing ranges because in such environments, the protectable surrounding areas can be made smaller than when conventional lead based projectiles are used. The frangible projectiles are much lighter and have fractionally greater velocity giving a substantially reduced momentum which greatly reduces the possible area of danger in firing ranges. In addition on impact with a solid surface the projectile breaks up into small particles and the likelihood of causing damage or injury from ricocheting particles is minimal. Further, as lead is not used the resulting projectile is environmentally desirable.

In the past, frangible projectiles have formed the subject of patent applications and particular reference is made to International Patent Application PCT/CA93/00043 (WO 93/16349) in the name SNC Industrial Technologies Inc. Reference should be made to that published specification for an understanding of frangible projectiles.

It is desirable that on firing of the frangible ammunition sufficient pressures are generated within the weapon to cause feeding mechanisms in a weapon to correctly operate. Such feeding mechanisms discharge the spent cartridge case and re-cock the weapon. In some cases, when frangible projectiles have been used, it has been necessary to re-design the bolt mechanism of such weapons to effect proper operation of the feeding mechanisms. Clearly, this is not desired. It is also necessary that the projectile has sufficient velocity to travel the length of a shooting range with a predictable flight trajectory. Typically, the range can be up to about 150 m. Within this range, the trajectory should be generally predictable, and not be near the end position of free travel of the projectile where there is considerable deviation from a line of sight between the muzzle end of the weapon and an intended target. It is also particularly desirable that the projectile not tumble during its flight.

OBJECT AND STATEMENTS OF THE INVENTION

It is therefore an object of the present invention to provide an improved frangible ammunition projectile.

In the aforementioned patent specification a number of problems have been outlined in attempting to achieve a satisfactory projectile. The present inventors have worked towards producing satisfactory ammunition and have found that improved results can be achieved by a specific range of compositions of the projectile itself.

Therefore, according to a first broad aspect of the present invention there may be provided a frangible ammunition projectile comprising a mixture of metal powder and a thermoplastic resin of nylon 11, said metal being about 80% by weight, said mixture having a specific gravity of greater than 2.35 and preferably about 3.8.

It is particularly preferred that said specific gravity be less than 5.7.

It is particularly preferred that said metal powder be bronze.

Preferably, said projectile has a conical nose having an included angle in the range 40–41 degrees.

Preferably, the forward end of said conical nose is blunt.

It is particularly preferred that said forward end be domed.

It is further preferred that said projectile have an external diameter in the range 5.68 mm to 5.72 mm and have a length in the range 15.0 mm to 15.5 mm.

It is further particularly preferred that said forward end have a diameter where it terminates with said conical nose in the range 1.3 mm to 1.5 mm. Most preferably said nose has a forward end which is domed and has a radius in the range 1.5 mm to 2.0 mm.

It is further particularly preferred that said projectile be fitted into a 5.56 mm×45 mm military cartridge case (equivalent to 0.223 inch Remmington case) and the overall length of said cartridge case and projectile be in the range of 55.0 mm to 55.5 mm.

It is further particularly preferred that the propellant be type AR2207 supplied by the applicant and be in the range 25–26 grains (1.7–1.8 g).

According to a second broad aspect of the present invention there may be provided a frangible ammunition projectile having a conical nose having an included angle in the range 40–41 degrees.

Preferably the forward end of said conical nose is blunt.

It is further particularly preferred that said forward end be domed.

It is further preferred that said projectile comprise a mixture of metal powder of about 80% by weight.

It is particularly preferred that said metal powder be bronze.

DETAILED DESCRIPTION OF PREFERRED EMBODIMENTS

Figure 1:
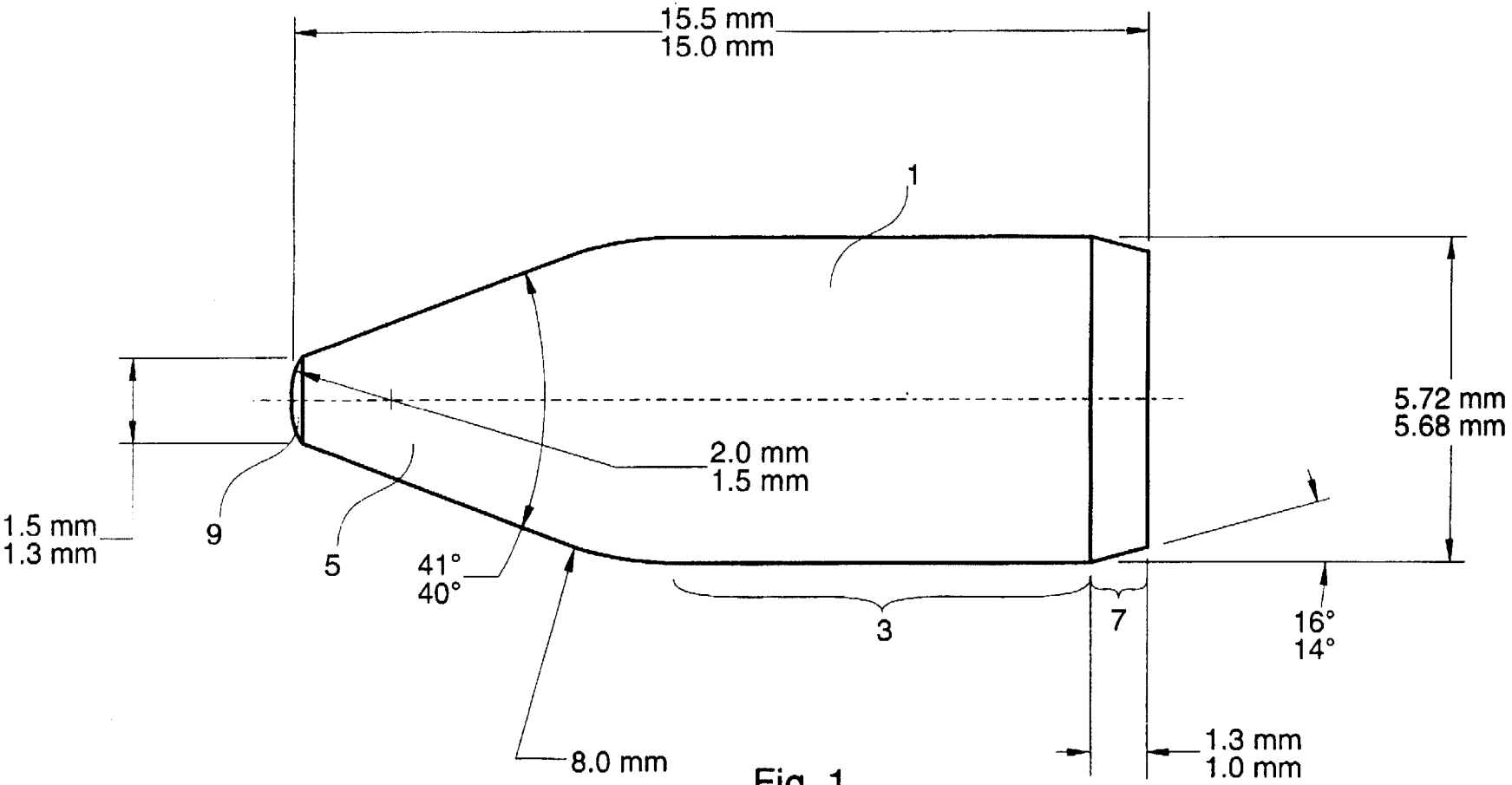
Figure 2:
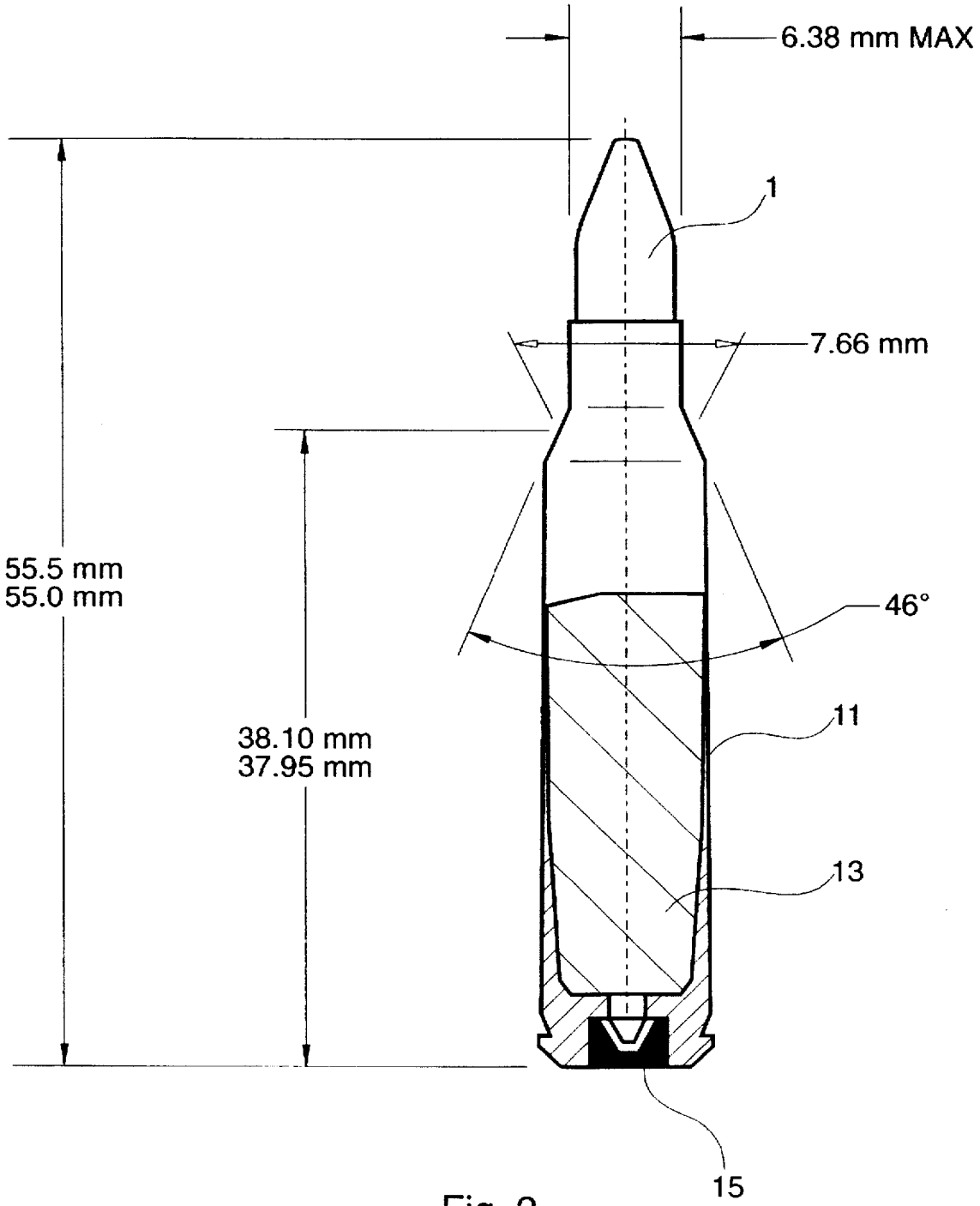

In order that the invention can be more clearly ascertained an example of a preferred embodiment will now be described with reference to the accompanying drawings wherein:

FIG. 1 is a side view of the example of the frangible ammunition projectile; and FIG. 2 is a part cross-sectional side view of the frangible projectile of FIG. 1 fitted in a cartridge case.

The frangible ammunition projectile 1 is circular in cross-section and comprises a mixture of finely ground metal powder—in this case bronze powder—, and a thermoplastic resin of nylon 11. The bronze powder preferably has a particle size of the range 0.04 to 0.1 mm diameter. A particularly preferred commercially available mixture is that manufactured by Atochem—polymer type, Rilsan (Registered Trade Mark) BMNYBZTL—and provides a mixture having a specific gravity of substantially 3.8. In this mixture the bronze is about 80% by weight. This polymer can be purchased from Atochem of 893 Princes Highway, Springvale, Victoria, Australia. The projectile therefore has a specific gravity considerably lower than 5.7 which is the minimum specific gravity referred to the aforementioned patent application PCT/CA93/00043 of SNC Industrial Technologies Inc.

The projectile 1 has a central cylindrical body part 3 with a forward conical nose 5 the included angle of which is in the range 40–41 degrees. It also has an inwardly flared tail end part 7 as well as a domed forward end 9. The domed forward end 9 provides a blunt end to the conical nose 5.

The domed forward end has a radius in the range 1.5 mm to 2.5 mm.

Further, the diameter of the projectile where it connects with its forward end 9 is in the range 1.3 mm to 1.5 mm.

FIG. 2 shows the projectile 1 fitted in a cartridge case 11 which, in turn, is filled with a propellant 13. The projectile 1 is held to the case 11 by crimping in the mouth end of the case 11 in a conventional manner. The cartridge case 11 has a known primer 15 therein for such cartridge case which is "ringed in" to hold it to the case 11 in a conventional manner. The propellant is type AR2207 supplied by applicant and is in the range of 25–26 grains (1.7–1.8 g).

The dimensions of the projectile 1 of the example are shown in the drawings and the projectile has a mass of approximately 1.2 g when produced using the Atochem polymer type Rilsan (Registered Trade Mark) BMNYBZTL previously referred to. The projectile 1 is mounted in a known military cartridge case 11 of 5.56 mm×45 mm (equivalent to Remmington 0.223 inch) so that there is an overall length of the ammunition of 55.0 mm to 55.5 mm. With the cartridge produced in accordance with the above specifications the projectile will have a velocity of approximately 1130 m/s at 23.8 m from the muzzle of the weapon.

The chamber pressure generated will be approximately 220 MPa measured by a piezo transducer method.

The port pressure on the weapon will be approximately 70 MPa measured by a piezo transducer method.

The action time is the time taken from when the firing pin strikes the primer 15 and the projectile leaves the muzzle of the weapon and in the case of use in a standard NATO test weapon, this time is approximately 0.70 m/sec.

The projectile 1 has a maximum range of about 800 m however, as previously explained, the useful range is up to about 150 m with predictable accuracy.

The ammunition can be used in indoor ranges, as the projectile 1 will disintegrate on impact with solid objects eliminating damage to the range butt and will achieve disintegration with an angle of incidence as low as 15°. The projectile will also travel without tumbling.

In addition, the shape of the projectile 1 and the use with a standard cartridge case 11 means that no modification is required to the weapon to permit use. This is particularly so in the case of a Steyr weapon which has difficult loading requirements. In the present case, the shape of the nose 5 and the forward end 9 and the relative dimensions thereof are such that the cartridge will correctly load into that weapon.

In addition, there is ballistic matching with military type SS109 ammunition to about 150 m.

Modifications may be made to the invention as would be apparent to persons skilled in the art. For example, the color of the projectile 1 may be suitably chosen by coloring the resin to identify the projectile as a frangible projectile. Alternatively, using the aforementioned material for the projectile 1, it has a natural olive green-grey color which is easily identifiable.

The cartridge may be lacquer coated as is now common in the military cartridge arts to render it airtight and to resist moisture penetration.

These and other modifications may be made without departing from the ambit of the invention, the nature of which is to be determined from the foregoing description.

We claim:

1. A frangible ammunition projectile comprising a mixture of metal powder and a thermoplastic resin of nylon 11, said metal being about 80% by weight of said projectile, said mixture having a specific gravity of greater than 2.35 and less than 5.7, said projectile having a conical nose with an included angle in the range of 40–41 degrees and wherein a forward end of said conical nose is blunt, said projectile having an external diameter in the range of 5.68 mm to 5.72 mm and a length in the range 15.0 mm to 15.5 mm.

2. A projectile as claimed in claim 1 wherein a forward end of said conical nose is domed.

3. A projectile as claimed in claim 2 wherein the radius of said forward end is in the range of 1.3 mm to 1.5 mm.

4. A projectile as claimed in claim 1 where the specific gravity of said mixture is about 3.8.

5. A cartridge comprising a projectile as claimed in claim 1 fitted in a 5.56 mm×45 mm military cartridge case, the overall length of said cartridge being in the range of from 55.0 mm to 55.5 mm.

6. A cartridge as claimed in claim 5 wherein said cartridge case contains a propellant in an amount of from 25–26 grains (1.7–1.8 g.).

* * * * *